US008861973B2

(12) United States Patent
Tam et al.

(10) Patent No.: US 8,861,973 B2
(45) Date of Patent: Oct. 14, 2014

(54) RAILWAY MONITORING SYSTEM

(75) Inventors: Hwa Yaw Tam, Hong Kong (CN); Siu Lau Ho, Hong Kong (CN); Michael Shun Yee Liu, Hong Kong (CN)

(73) Assignee: The Hong Kong Polytechnic University, Kowloon (HK)

( * ) Notice: Subject to any disclaimer, the term of this patent is extended or adjusted under 35 U.S.C. 154(b) by 1249 days.

(21) Appl. No.: 10/594,068

(22) PCT Filed: Mar. 25, 2005

(86) PCT No.: PCT/CN2005/000385

§ 371 (c)(1),
(2), (4) Date: Dec. 26, 2006

(87) PCT Pub. No.: WO2005/093971

PCT Pub. Date: Oct. 6, 2005

(65) Prior Publication Data

US 2008/0019701 A1 Jan. 24, 2008

(30) Foreign Application Priority Data

Mar. 29, 2004 (EP) ..... 04251840

(51) Int. Cl.

| | |
|---|---|
| ***G01L 1/24*** | (2006.01) |
| ***G01L 11/02*** | (2006.01) |
| ***B61L 23/04*** | (2006.01) |
| ***B61L 1/16*** | (2006.01) |

(52) U.S. Cl.

CPC ..... *B61L 1/166* (2013.01); *B61L 23/041* (2013.01)

USPC ..... 398/140

(58) Field of Classification Search

CPC ..... G01L 11/02; G01L 1/24

USPC ..... 398/41, 140–141; 246/246, 247, 249

See application file for complete search history.

(56) References Cited

U.S. PATENT DOCUMENTS 5,330,136 A * 7/1994 Colbaugh ..... 246/122 R
5,493,390 A * 2/1996 Varasi et al. ..... 356/32

(Continued)

FOREIGN PATENT DOCUMENTS

JP 11-59418 3/1999
JP 2003-139508 5/2003

OTHER PUBLICATIONS

Zhang et al., "Tuning Bragg WAvenegth by Writing Gratings on Prestrained Fibers", Jul. 1994, IEEE Photonics Technology Letters, vol. 6, No. 7, pp. 839-841.*

(Continued)

*Primary Examiner* — David Payne
*Assistant Examiner* — Tanya Motsinger
(74) *Attorney, Agent, or Firm* — Jacobson Holman, PLLC.

(57) ABSTRACT

A railway monitoring system firstly includes an optical fiber. A first part of the fiber is attachable to one of a pair of tracks of a rail, and a characteristic of the first part of the fiber is variable in correspondence to variance of a characteristic of said one track where the first part of fiber is attached. The system also includes an optical signal emitter connected to the fiber for emitting an optical signal into the fiber, and the fiber generates at least a first altered optical signal, which contains information relating to the variance of the characteristic of the part of the fiber. The system further includes an optical signal analyzer connected to the fiber for receiving and analyzing the first altered optical signal so as to ascertain the variance of said characteristic of said one track based upon the information contained in the first altered optical signal.

11 Claims, 2 Drawing Sheets

(56) References Cited

U.S. PATENT DOCUMENTS

| | | | | |
|---|---|---|---|---|
| 5,641,956 | A * | 6/1997 | Vengsarkar et al. | 250/227.14 |
| 5,680,489 | A | 10/1997 | Kersey | |
| 5,844,927 | A * | 12/1998 | Kringlebotn | 372/6 |
| 6,072,567 | A * | 6/2000 | Sapack | 356/32 |
| 6,377,727 | B1 * | 4/2002 | Dariotis et al. | 385/37 |
| 7,714,271 | B1 * | 5/2010 | Levine | 250/227.14 |
| 8,576,385 | B2 * | 11/2013 | Roberts | 356/32 |
| 2001/0022804 | A1 * | 9/2001 | Helmig et al. | 374/161 |
| 2003/0094281 | A1 * | 5/2003 | Tubel | 166/250.03 |
| 2004/0052444 | A1 * | 3/2004 | Moslehi et al. | 385/13 |
| 2004/0129083 | A1 * | 7/2004 | Fernald et al. | 73/705 |
| 2006/0070446 | A1 * | 4/2006 | Tam et al. | 73/705 |
| 2007/0279632 | A1 * | 12/2007 | Delmas et al. | 356/429 |

OTHER PUBLICATIONS

M.A. Davis et al., Matched-filter interrogation technique for fibre Bragg grating arrays, Electronics Letters, vol. 31, No. 10, pp. 822-823.

R.P. Kenny et al., Fibre optic in-fibre Bragg grating sensors for use in composite material structural element characterisation and structural monitoring, Proceedings fo the IEE Colloquium on Optical Technique for Smart Structures and Structural Monitoring, Feb. 17, 1997, Paper 11, pp. 1-6.

* cited by examiner

RAILWAY MONITORING SYSTEM

This is a nationalization of PCT/CN2005/000385 filed 25 Mar. 2005 and published in English.

FIELD OF THE INVENTION

The present invention relates to railway monitoring systems.

BACKGROUND OF THE INVENTION

Various measurement mechanisms have been used to monitor various aspects of a railway system. Axle counter and wheel imbalance weighting system are two popular measurement mechanisms among them.

Conventionally, an axle counter uses magnetic fields to count the axles of a passing train, and a typical wheel imbalance weighting system uses a strain gauge sensor in a bridge circuit to measure the load of the train. Disadvantages exist with these conventional mechanisms, for example, installation of some conventional measurement mechanism may not be easy. More importantly, performance of these conventional mechanisms may be affected by external electromagnet radiation. This may deteriorate the reliability of these conventional measurement mechanisms, especially in an AC railway system, since lots of noises could be introduced to these conventional measurement mechanisms. In addition, these conventional measurement mechanisms need to be individually installed onto the railway. This may not be convenient if a significant number of measurement mechanisms are needed. Neither can it be convenient to set up a centralized railway monitoring system due to the complexity of collection of all the results from each individual measurement mechanism.

SUMMARY OF THE INVENTION

Therefore, it is an object of the present invention to provide an improved railway monitoring system that may solve at least part of the problems, or at least provide the public with a useful choice.

According to an aspect of present invention, a railway monitoring system firstly includes an optical fiber. A first part of the fiber is attachable to one of a pair of tracks of a rail, and a characteristic of the first part of the fiber is variable in correspondence to variance of a characteristic of said one track where the first part of fiber is attached. The system also includes an optical signal emitter connected to the fiber for emitting an optical signal into the fiber, and the fiber generates at least a first altered optical signal, which contains information relating to the variance of the characteristic of the part of the fiber. The system further includes an optical signal analyzer connected to the fiber for receiving and analyzing the first altered optical signal so as to ascertain the variance of said characteristic of said one track based upon the information contained in the first altered optical signal.

Preferably, both the emitter and the analyzer are connected to an end of the fiber, and the first altered optical signal is a signal reflected by the fiber towards the end.

According to another aspect of the present invention, a process for monitoring a railway system includes

- placing an optical fiber along at least a part of a track of a rail;
- attaching a portion of the optical fiber to said track such that a characteristic of the fiber varies with a variance in the track;

- emitting a signal along said fiber that may be altered by said variance of the portion of the fiber; and
- analyzing the varied signal to determine information relating to said rail.

Other aspects and advantages of the invention will become apparent from the following detailed description, taken in conjunction with the accompanying drawings, which description illustrates by way of example the principles of the invention.

DETAILED DESCRIPTION OF THE PREFERRED EMBODIMENT

Figure 1:
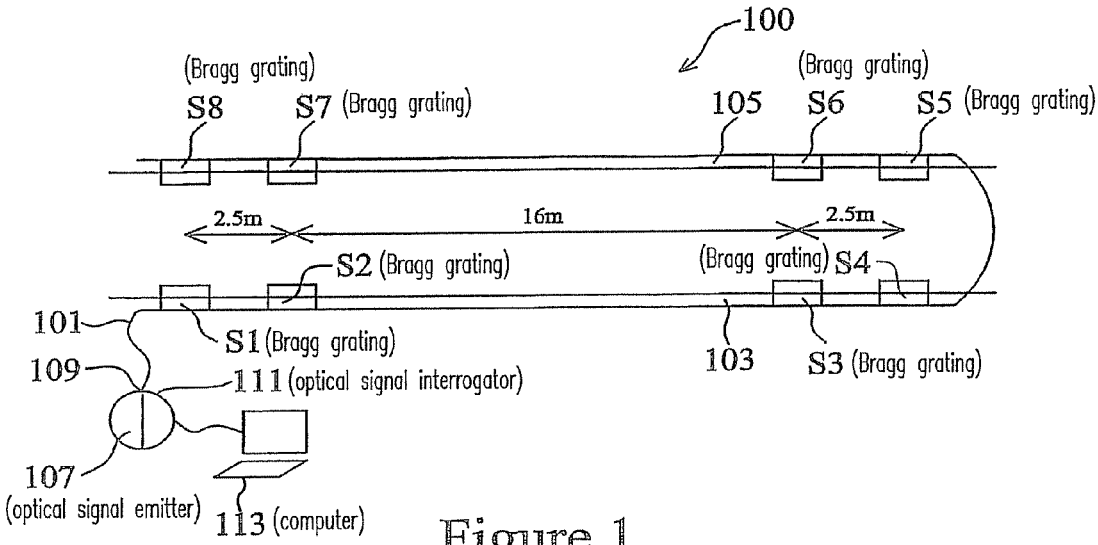
FIG. 1 is a plan view illustrating an exemplary railway monitoring system embodiment of the present invention.

As shown in FIG. 1, an exemplary railway monitoring system 100 of the present invention includes an optical fiber 101 having eight Bragg gratings S1-S8, which are created in the fiber 101 and which are selectively attached to a pair of tracks 103, 105 of a railway respectively. An optical signal emitter 107 providing a broad band light source is connected to one end 109 of the fiber 101 for emitting an optical signal into the fiber 101. Each Bragg grating S1-S8 has a distinct reflected wavelength (to be discussed with reference to FIG. 3) and reflects an optical signal towards the end 109, and each reflected optical signal contains information reflecting variance of a characteristic of a part of the tracks where the Bragg gratings S1-S8 are mounted. The wave band of the optical signal from the emitter 105 is broad enough to cover all the reflected wavelengths of the Bragg gratings S1-S8 in the exemplary embodiment, An optical signal interrogator 111, also connected to the end 109, receives these reflected signals and further detects a shift in the wavelength of each reflected optical signal as discussed in details below. The interrogator then passes the detection results to a computer 113 for analysis thereof. Based on these reflected optical signals, the interrogator 111 and the computer 113 are able to ascertain certain situations in the tracks 103, 105 and further to monitor the railway. It is noted that the exemplary system merely has an optical fiber in the railway region and therefore is not affected by external electromagnet radiations.

Figure 3:
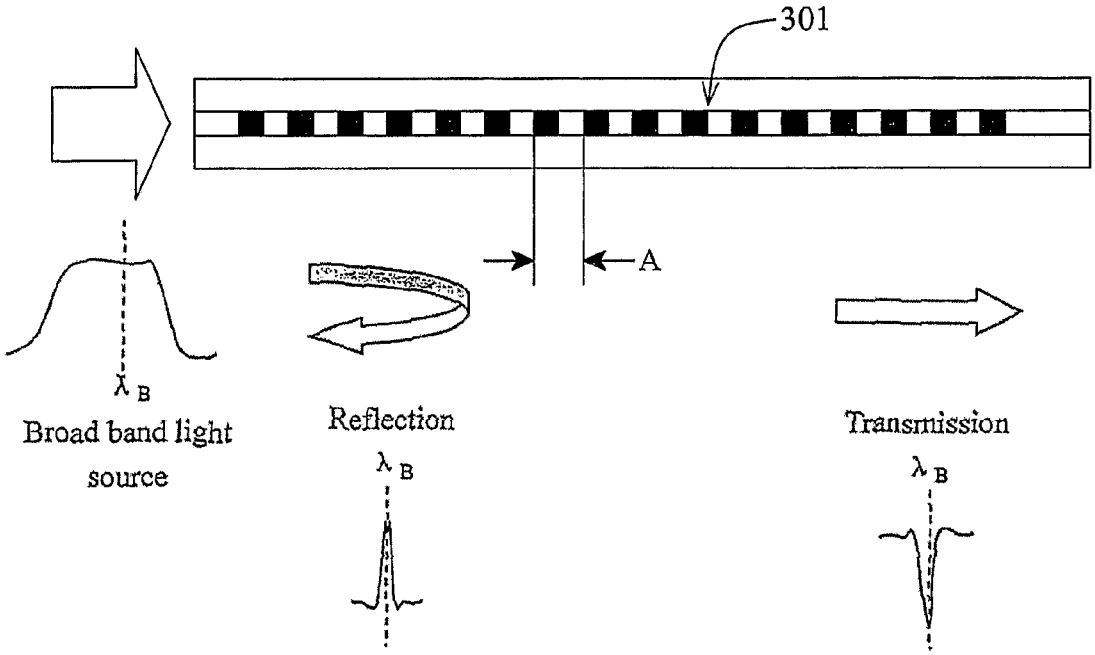
FIG. 3 illustrates working principles of a Bragg grating useful in the system of FIG. 1.

Working principles of a Bragg grating is discussed with reference to FIG. 3. As generally understood in the art, a Bragg grating 301 is a single modus fiber with permanent periodic variation of the refractive index over a fiber length of, for example 0.1 to 10 cm. The variation in the refractive index is established by illuminating the fiber with a UV laser. The Bragg grating 301 reflects light with a distinct reflected wavelength that depends upon the refractive index and the space related period of the variation of the refractive index (the grating period), while light beyond this wavelength will pass through the grating more or less unhindered. The light reflected by the Bragg grating 301 will exhibit a wavelength that varies as a function of a measurable quantity that changes the refractive index of the fiber material grating and/or the fiber length in the grating zone (grating period). Changes in either the tension in the fiber or the environment temperature will therefore lead to shift in the wavelength of the optical signal reflected by the Bragg grating 301. Furthermore, as generally understood in the art, in the situation of the exemplary embodiment of the present invention, since each Bragg grating S1-S8 has a distinct reflected wavelength, the interrogator can identify the reflected optical signals by these Bragg gratings so long as the wavelength interval between the Bragg gratings is designed to be longer than the allowable maximum shift in the wavelength of the reflected signals, which shift can be caused by changes in either the tension in the fiber or the environment temperature.

Figure 2:
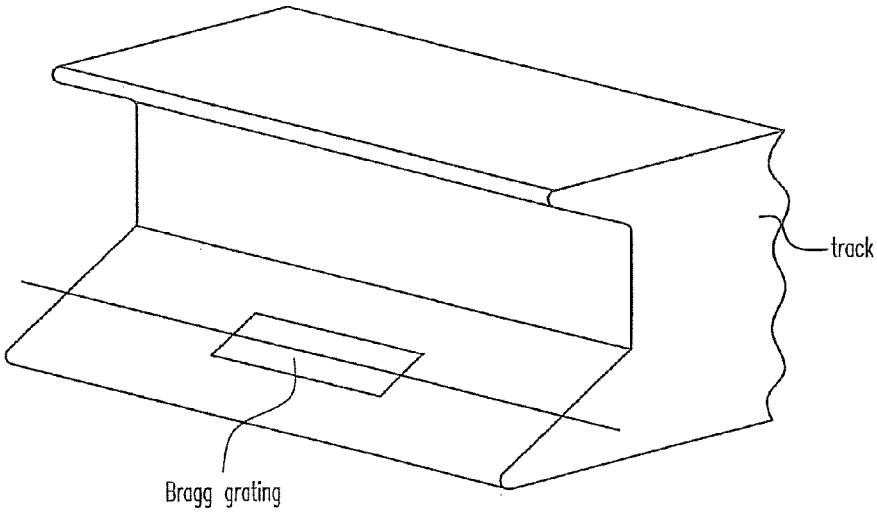
FIG. 2 is a perspective view illustrating attachment of part of the system of FIG. 1.

In addition, as shown in FIG. 2, in the exemplary embodiment, each Bragg grating S1-S8 is mounted to the track through Epoxy glue or welding in a direction parallel to the tracks 103, 105. Each Bragg grating is pre-strained to avoid the Bragg gratings losing tension in operation. Furthermore, each Bragg grating extends at least substantially parallel to its respective track.

Therefore, in the system 100, when an axle of a train passes over a portion of one of the tracks where a Bragg grating, for example S1, is mounted, the portion of the track experiences a tensile strain due to the pressure or weight exerted thereon by the axle of the train. Since the Bragg grating S1 is fixedly mounted to the track 103 and extends parallel to the track 103, the Bragg grating S1 experiences the same tensile strain as the track. Such a tensile strain leads to a shift in the wavelength of the optical signal reflected by the Bragg grating S1, and this shift is proportional to the tensile strain both the Bragg grating and the track experience and correspondingly to the pressure exerted on the track. By detecting this shift by the interrogator 111, the system 100 thereby obtains information relating to the tensile strain both the Bragg grating and the track experience and correspondingly the pressure exerted on the track. When the axle leaves the portion of the track, both the track and the Bragg grating S1 restore quickly such that the shift in the wavelength of the reflected signal by S1 decreases to zero accordingly, and the Bragg grating S1 is then ready for the next tensile strain, which may caused by another axle.

Therefore, based on the shifts in the wavelengths of the reflected optical signals by the Bragg gratings, the system 100 is able to ascertain certain situations in the tracks 103, 105 and further to monitor the railway.

INDUSTRIAL APPLICABILITY

1. Axle Counter

The exemplary system 100 can be used to count the number of axles of a passing train by counting the number of successive shifts in the wavelength of optical signal reflected by one of the Bragg gating. The system 100 is also able to determine the end of the train if it does not detect any shifts in the wavelength during a predetermined period, which is designed to be substantially longer than a possible maximum period of time for two adjacent axles to pass through the Bragg grating.

2. Speed Detector

Since the physical separation between the axles of a train is generally known, the exemplary system 100 may easily ascertain the instantaneous speed of the train by using the period of time taken for successive axles to pass through a particular Bragg grating.

3. Headway Optimization

The exemplary system 100 can easily find out the start and end of a passing train. The exemplary system 100 can further ascertain a period of time between two successive trains by

- constantly measuring a period of time between two successive shifts in the wavelength of the first reflected optical signal;
- comparing the period of time between two successive shifts with a predetermined threshold value; and
- determining the period of time between two successive trains if the period of time between two successive shifts exceeds the predetermined threshold value.

The information about the period of time between two successive trains can then be used by the exemplary system 100 to control the speed of these two trains.

4. Flood Detector

It is understood that changes in either the tension in the fiber or the environment temperature will lead to shifts in the wavelength of the optical signal reflected by the Bragg grating. It is further understood that flooding may generally cause a sudden change in the environment temperature. Therefore, when the exemplary system 100 detects a shift in the wavelength of the reflected signal while simultaneously does not detect any substantial variance of this shift during a predetermined period, the exemplary system 100 may trigger a flooding alert. The predetermined period is preset to be at least longer than the possible maximum period of time for two adjacent axles to pass through a particular Bragg grating. Therefore, if the system 100 does not detect any substantial changes of the shift in the wavelength of a reflected optical signal during the predetermined period, it is very likely that there are not any trains passing through the Bragg grating. Therefore, the shift in the reflected wavelength is very likely caused by the change in the environment temperature, and a very possible reason for the change in the environment temperature is the occurrence of flooding.

5. Wheel Imbalance Weighting System

As the Bragg gratings S1-S8 are installed on the two tracks of a rail, the computer can process the data received from the interrogator to evaluate whether there is any imbalance between the two tracks of the rail.

6. Train Weighting System

Since the shift in the reflected wavelength reflects the strain, which the track experiences and which relates to the weight thereabove, the weight of a train can be measured by adding all the strain measurements along the entire train. Such a weighting system is particularly useful in the situations when the train is static or moves at a relatively low speed.

7. Train Identification

As shown in FIG. 1, the Bragg gratings S1-S8 are selectively positioned on the tracks 103, 105. In particular, the spacing between S1 and S2, S3 and S4, S5 and S6, and S7 and S8 is designed to be in line with the spacing between two adjacent axles of a particular train, while the spacing between S2 and S3, and S6 and S7 is designed to be in line with the spacing between the bogies of this particular train. By detecting whether these eight Bragg gratings simultaneously experience a tensile strain, the system 100 is able to ascertain whether the train thereabove is the same type as said particular one.

It is understood that a number of Bragg gratings can be created in a single optical fiber as illustrated in the exemplary embodiment to monitor various factors of the railway system for a long distance. Alternatively, more than one fibers can be used in the system, each with a plurality of Bragg gratings created therein. Furthermore, each Bragg grating can be mounted to the tracks in a direction non-parallel to its respective track. In that case, the tensile strain the Bragg gratings experience may not be the same as the one the tracks experience. But the tensile strain the Bragg gratings experience is still relevant, if not exactly proportional to the one the tracks experience. Therefore, the system 100 is still able to ascertain the tensile strain the tracks experience based on the shifts in the wavelengths of the optical signals reflected by the Bragg gratings.

In addition, the exemplary system 100 uses the optical signals reflected by the Bragg gratings. It can be understood from FIG. 3 that the optical signal transmitted through all the Bragg gratings can also be used for similar analysis. In this case, the interrogator needs to be connected to the other end of the fiber.

The invention claimed is:

1. A monitoring system for a train moving on a pair of railway tracks, comprising:

an optical fiber, wherein a first part of the fiber is attachable to one of the pair of railway tracks, the first part of the fiber including a first Bragg grating that is pre-strained in a direction at least substantially parallel to said one track;

an optical signal emitter connected to a first end of the fiber configured to emit an optical signal into the fiber, wherein the first Bragg grating generates at least a first altered optical signal that is a reflected optical signal, and which contains information relating to a variance of a grating period of the first Bragg grating, wherein the grating period is variable in correspondence to a change in a tensile strain on the first Bragg grating;

an optical signal analyzer connected to the first end of the fiber configured to receive and to analyze the first altered optical signal so as to ascertain the variance of said tensile strain of the first Bragg grating based upon the information contained in the first altered optical signal; and a processor configured to receive an analysis of the first altered optical signal from the optical signal analyzer and to correlate the variance of said grating period of the first Bragg grating with a corresponding variance of said tensile strain of the first Bragg grating; and to further correlate the variance of said tensile strain of the first Bragg grating with a characteristic of the train moving on the pair of tracks.

2. The system of claim 1, wherein the first Bragg grating is attached to said one track such that the variance of said tensile strain of said first Bragg grating correlates with a corresponding variance of a tensile strain of said one track, which in turn correlates with the characteristic of the train moving on the pair of tracks.

3. The system of claim 1, wherein the optical signal analyzer is configured to ascertain the variance of said grating period of the first Bragg grating by detecting a shift in a wavelength of the first reflected optical signal.

4. The system of claim 3, further comprising a counter in connection with the optical signal analyzer that is configured to count a number of the shifts in the wavelength of the first reflected optical signal, wherein said processor is configured to correlate the number of shifts with a characteristic that is a number of axles of the train moving over the first Bragg grating on the pair of tracks.

5. The system of claim 4, further comprising a clock in connection with the optical signal analyzer, the clock configured to measure a period of time between a predetermined number of successive shifts in the wavelength of the first reflected optical signal, where the processor is configured to correlate the measured period of time with a characteristic that is a speed of the train moving on the pair of tracks.

6. The system of claim 3, wherein the processor is configured to calculate a period of time between two successive trains by constantly measuring a period of time between two successive shifts in the wavelength of the first reflected optical signal;

comparing said constantly measured period of time between two successive shifts with a predetermined threshold value; and when said measured period of time between two successive shifts exceeds the predetermined threshold value, correlating said excessive period of time with the period of time between two successive trains.

7. The system of claim 3, wherein the grating period of the first Bragg grating is variable in correspondence to a change in an environment temperature for the first Bragg grating.

8. The system of claim 7, wherein the optical signal analyzer is configured to detect a change in the environment temperature by determining whether or not a shift in the wavelength of the first reflected optical signal occurs; and simultaneously determining whether such a shift varies during a predetermined period.

9. The system of claim 3, further comprising a second Bragg grating in a second part of the fiber attachable to the other track of the pair of railway tracks, wherein the second Bragg grating is configured to generate a second altered optical signal that is a reflected optical signal receivable by the optical signal analyzer and which contains information relating to a variance of a grating period of the second Bragg grating, where the grating period is variable in correspondence to a change in a tensile strain on the second Bragg grating, wherein the optical signal analyzer is configured to receive and to analyze the second altered optical signal and to correlate the variance of said tensile strain of the second Bragg grating based upon the information contained in the second altered optical signal with a corresponding variance of said tensile strain of the second Bragg grating; and to further correlate the variance of said tensile strain of the second Bragg grating with a characteristic of the train moving on the pair of railway tracks via the second track.

10. The system of claim 9, wherein the processor, in connection with the optical signal analyzer, is configured to ascertain an imbalance existing between the pair of tracks based upon the shifts in the wavelengths of the first and second reflected optical signals.

11. The system of claim 10, further comprising a plurality of additional Bragg gratings disposed in the fiber and attachable to one of the pair of railway tracks, wherein the first, second and plurality of additional Bragg gratings are each positioned so as to correspond to a spacing between adjacent axles and bogies of the train for ascertaining the characteristic of the train moving on the pair of tracks.

* * * * *